US005979889A

United States Patent [19]

Klopfenstein

[11] Patent Number: 5,979,889

[45] Date of Patent: Nov. 9, 1999

[54] APPARATUS FOR GENERATING A VACUUM

[75] Inventor: Andrew L. Klopfenstein, Tipp City, Ohio

[73] Assignee: Heidelberger, Druckmaschinen AG, Heidelberg, Germany

[21] Appl. No.: 08/842,530

[22] Filed: Apr. 15, 1997

[51] Int. Cl.[6] ..... B65H 39/02

[52] U.S. Cl. ..... 271/11; 271/102; 271/106

[58] Field of Search ..... 271/11, 99, 100, 271/102, 106, 107

[56] References Cited

U.S. PATENT DOCUMENTS

| | | | |
|---|---|---|---|
| 3,591,167 | 7/1971 | Norbutas | 271/11 |
| 3,884,368 | 5/1975 | Ballard . | |
| 3,998,448 | 12/1976 | Gray et al. | 271/12 |
| 4,157,692 | 6/1979 | Brocklehurst et al. | 271/20 |
| 4,531,723 | 7/1985 | Watson | 271/97 |
| 4,830,352 | 5/1989 | Birtwhistle . | |
| 4,958,824 | 9/1990 | Willits et al. | 271/1 |
| 4,986,524 | 1/1991 | Meintzer et al. . | |
| 5,603,599 | 2/1997 | Wesslen et al. . | |

FOREIGN PATENT DOCUMENTS

| | | |
|---|---|---|
| 1912395 | 1/1970 | Germany . |
| 2852681 | 12/1980 | Germany . |
| 3526520 | 6/1986 | Germany . |
| 1109717 | 10/1968 | United Kingdom . |
| 2247450 | 4/1992 | United Kingdom . |

*Primary Examiner*—Dean Kramer
*Assistant Examiner*—Gregory A. Morse
*Attorney, Agent, or Firm*—Tarolli, Sundheim, Covell Tummino & Szabo

[57] ABSTRACT

Apparatus (10) for engaging at least a portion **(20*b*) of a signature (20*a*) in a hopper (14) and moving the portion relative to a stack of signatures (20) in the hopper includes a stem member (110) and a suction cup (150) mounted on the stem member. The stem member (110) is supported for movement toward and away from the stack of signatures (20) A venturi tube (160) is provided in the stem member (110) for generating a vacuum which is communicated to the suction cup (150). The vacuum in the suction cup (150) causes the portion (20*b*) of a signature (20*a*) to be gripped by the suction cup (150) and moved relative to the stack of signatures (20) in the hopper (14) upon movement of the stem member (110)**.

8 Claims, 2 Drawing Sheets

APPARATUS FOR GENERATING A VACUUM

BACKGROUND OF THE INVENTION

1. Technical Field

The present invention relates to an apparatus for generating a vacuum, and particularly relates to an apparatus for generating a vacuum in a suction head for engaging and moving a signature relative to a stack of signatures in a hopper.

2. Description of the Prior Art

It is known in the art to engage and move a signature relative to a stack of signatures in a hopper using one or more suction heads. Each suction head is connected by an air line to a source for generating a vacuum, such as a vacuum pump, which is remotely located relative to the suction head. Because the air lines have to be evacuated before a vacuum is pulled in each suction head, there is an inherent time delay between the initiation of the vacuum source and a vacuum being achieved at the suction head. Further, the air lines have to be blown down periodically to clean out paper dust which can become trapped in the vacuum system.

SUMMARY OF THE INVENTION

The present invention is a apparatus for generating a vacuum in a suction head for engaging at least a portion of a signature in a hopper and moving the portion relative to a stack of signatures in the hopper. The apparatus comprises a stem member, a suction cup mounted on the stem member, and means for supporting the stem member for movement toward and away from the stack of signatures. Means is provided in the stem member for generating a vacuum which is communicated to the suction cup. The vacuum in the suction cup causes the portion of a signature to be gripped by the suction cup and moved relative to the stack of signatures in the hopper upon movement of the stem member. The means for generating a vacuum which is communicated to the suction cup includes a venturi tube.

The apparatus further comprises a pressure manifold and an air inlet line. The pressure manifold is fluidly connected by the air inlet line to the venturi tube. An electronically controlled air pressure valve is connected to a pressurized air supply. The electronically controlled air pressure valve is fluidly connected to the pressure manifold and is operable to control the flow of pressurized air from the pressurized air supply to the pressure manifold.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF THE PREFERRED EMBODIMENTS

Figure 1:
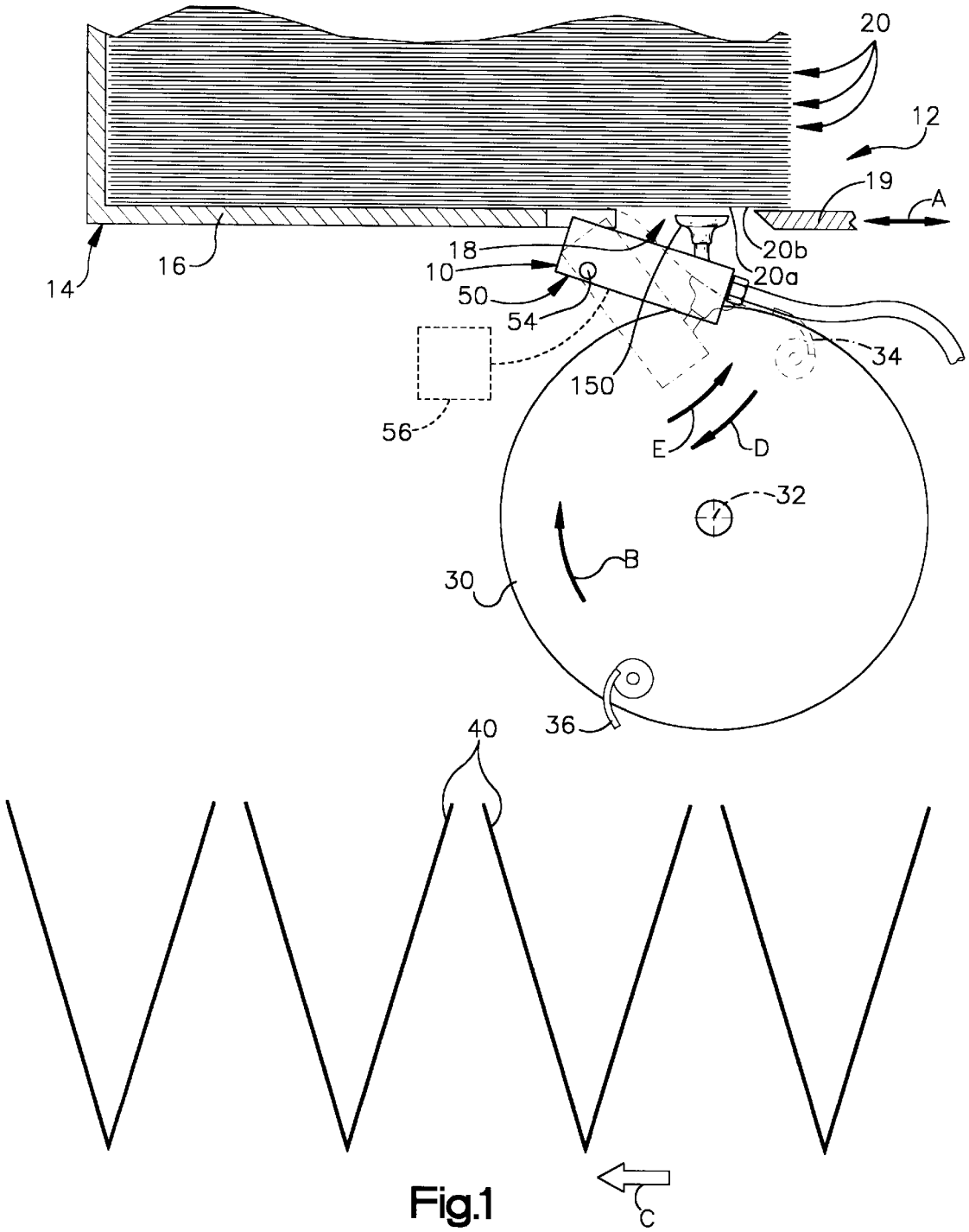
FIG. 1 is a schematic view of a portion of a collating machine which includes an apparatus for generating a vacuum constructed in accordance with the present invention.

The present invention relates to an apparatus for generating a vacuum in a suction head for engaging and moving a signature relative to a stack of signatures in a hopper. The present invention is applicable to various types of gathering and/or collating machines. As representative of the present inventions FIG. 1 schematically illustrates a vacuum apparatus 10. The vacuum apparatus 10 is incorporated in a machine 12 for forming a collated assemblage of sheet material articles, such as inserts, signatures, etc.

The machine 12 includes a plurality of hoppers located along a conveyor. The hoppers feed sheet material articles into receiving locations on the conveyor. One hopper 14 is shown in FIG. 1 The other hoppers are similar to the hopper 14 shown. The conveyor, as shown in FIG. 1, includes a plurality of collator pockets 40 which move past the hoppers. Sheet material articles are fed into the pockets 40 as the pockets move past the hoppers to form the collated assemblages.

The hopper 14 comprises a sheet material article support 16 having a removal window 18 and a retractable signature support 19. A plurality of signatures 20 are stacked on the support 16 as shown in FIG. 1. The retractable support 19 is disposed on the opposite side of the removal window 18 from the support 16 and is movable in the directions indicated by arrow A. The support 19 supports the outermost end of the stack of signatures 20 in the hopper 14. The support 19 is schematically shown and may take a variety of forms and could be a rotatable separator disk.

A rotating drum 30 is located underneath the removal window 18 of the hopper 14. The drum 30 is supported for clockwise rotation, as viewed in FIG. 1, about an axis 32 as indicated by arrow B. A pair of gripper fingers 34 and 36 are disposed on the drum 30. The gripper fingers 34 and 36 are spaced 180° apart and rotate with the drum 30. The gripper fingers 34 and 36 are also independently rotatable with respect to the drum 30 to grip and release a signature. The plurality of collator pockets 40 are located underneath the rotating drum 30. The collator pockets 40 have a V-shaped cross-section and are part of the conveyor (not shown) which moves in the direction of arrow C relative to hopper 14, and the other hoppers.

Figure 2:
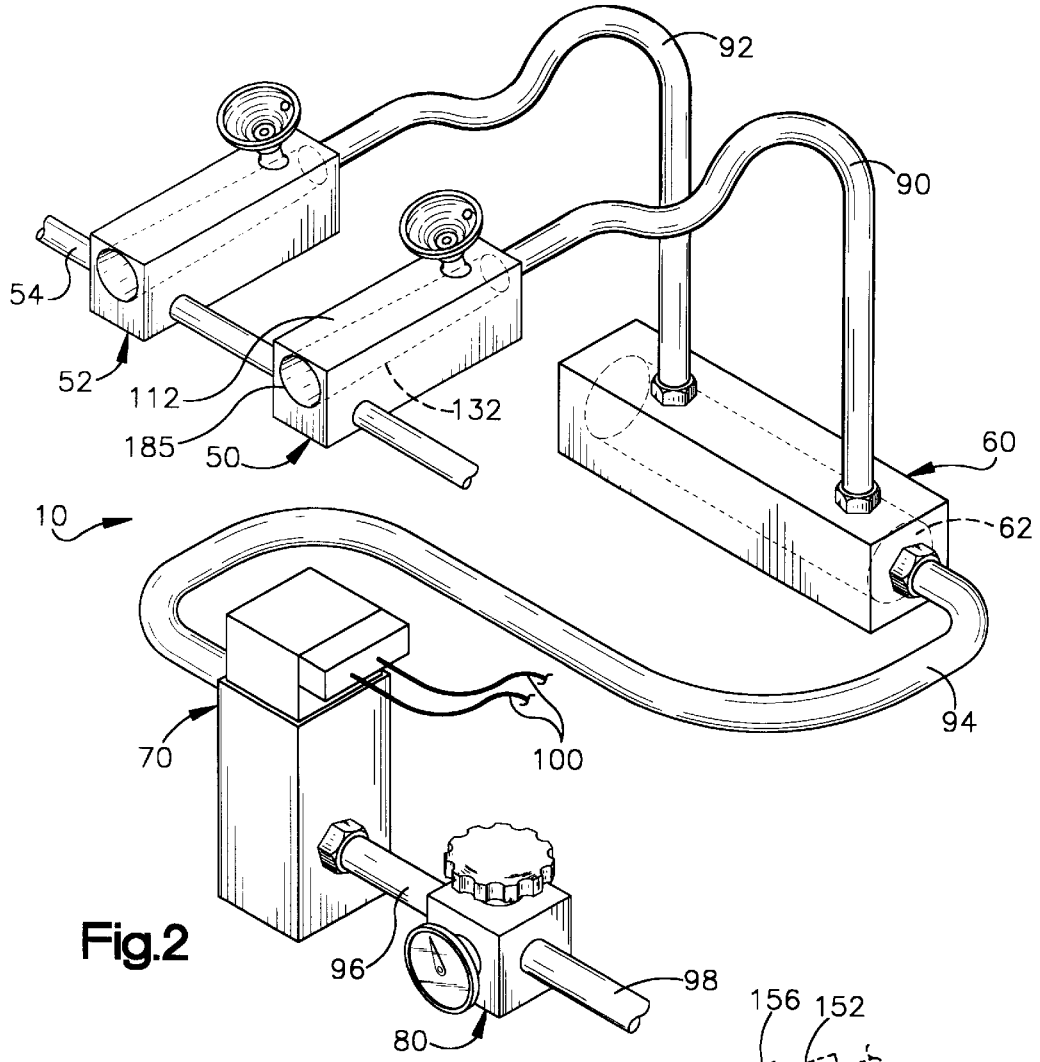
FIG. 2 is a perspective view of the apparatus for generating a vacuum.

The vacuum apparatus 10 is located adjacent the removal window 18 of the hopper 14 and the rotating drum 30 and comprises a pair of suction heads 50 and 52 (FIG. 2). It should be obvious to one skilled in the art that the vacuum apparatus 10 could include only one suction head or more than two suction heads. The suction heads 50 and 52 are mounted on and fixed for rotation with a rod 54. The suction heads are connected to a mechanism 56 for rotating the suction heads 50 and 52 toward and away from the stack of signatures 20 as indicated by arrows D and E, respectively.

Referring now to FIG. 2, the vacuum apparatus 10 further includes a pressure manifold 60 having an internal chamber 62, an electronically controlled air pressure valve 70, and a pressure regulator 80. Flexible air inlet lines 90 and 92 connect the suction heads 50 and 52, respectively, to the pressure manifold 60. An air supply line 94 connects the manifold 60 to the electronically controlled valve 70. Another air supply line 96 connects the valve 70 to the pressure regulator 80. A main supply line 98 connects the regulator 80 to a source of pressurized air (not shown) of approximately 80 psi.

The electronically controlled valve 70 is a 0–24 volt DC device which is electrically connected to a system controller (not shown) by wiring 100. The system controller is operable to turn the electronically controlled valve 70 on and off, thereby opening and closing the valve.

Figure 3:
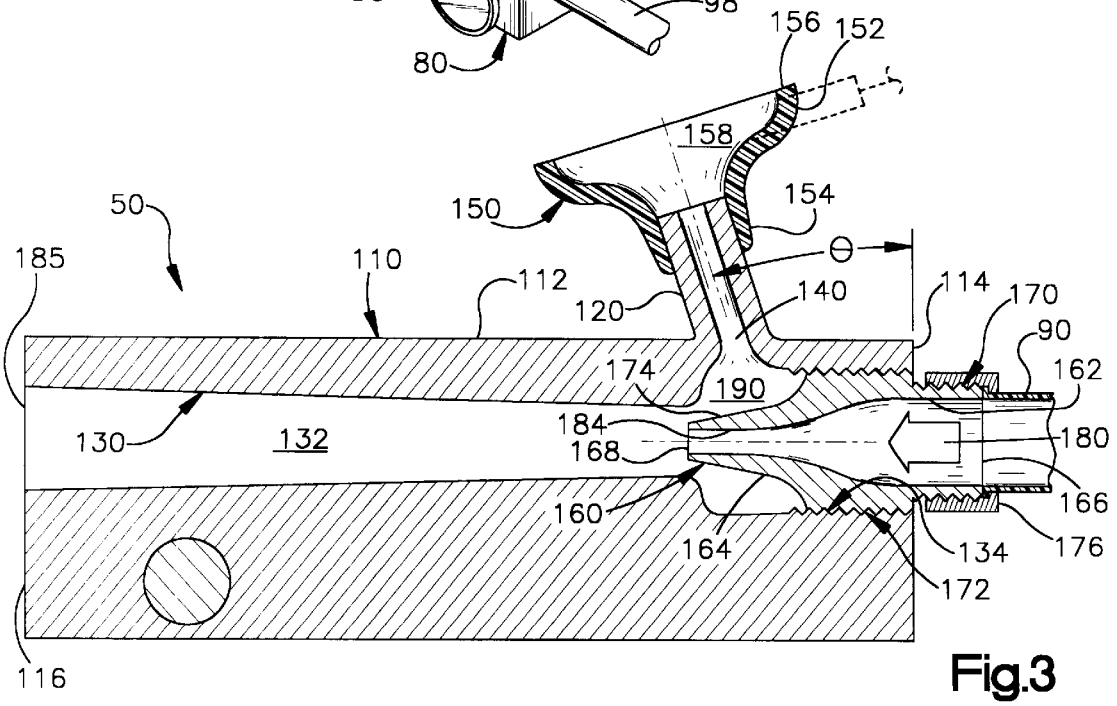
FIG. 3 is a sectional view of a portion of FIG. 2.

The suction heads 50 and 52 are identical and therefore only one of the pair of suction heads will be described in detail. As shown in FIG. 3, the suction head 50 comprises a substantially rectangular-shaped stem member 110, a suction cup 150, and a venturi tube 160. The stem member 110 includes an upper surface 112 which faces the hopper 14, a first end 114, and a second end 116. A cylindrical leg 120 extends outward from the upper surface 112 of the stem member 110 at an angle θ with respect to the first end 114 of the stem member. The angle θ is preferably between 10–30°. The angle between the leg 120 and upper surface 112 of the stem member 110 is between 60° and 80° when the angle θ is between 10° and 30°. When the suction cup 150 engages a signature 20 (FIG. 1), the leg 120 (FIG. 3) extends perpendicular to the signature. The stem member 110 as shown is merely illustrative and could be of a different shape and/or construction.

The stem member 110 has a generally frustoconical inside surface 130 which defines an axially oriented first passage 132. The first passage 132 extends from the first end 114 of the stem member 110 to the second end 116. The first passage 132 includes a threaded portion 134 adjacent the first end 114 of the stem member 110 A second passage 140 in the stem member 110 extends from an area of the first passage 132 adjacent the threaded portion 134 to the outside of the stem member 110 through the cylindrical leg 120. The second passage 140 is shown as having a smaller diameter than the diameter of the first passage 132, although it should be obvious to one skilled in the art that the first and second passages 132 and 134, respectively, could be substantially similar in diameter.

The suction cup 150 is disposed on the cylindrical leg 120 of the stem member 110. The suction cup 150 is made from a resilient material,, such as rubber, and includes an upper section 152 and a lower section 154. The dimensions of the lower section 154 of the suction cup 150 are selected so as to fit tightly around the exterior of the cylindrical leg 120. The upper section 152 has a larger outside diameter than the outside diameter of the lower section 154. The upper section 152 includes a peripheral lip 156 which defines a vacuum cavity 158 in the suction cup 150. The vacuum cavity 158 faces generally upward toward the stack of signatures 20 in the hopper 14. The second passage 140 in the stem member 110, which extends through the cylindrical leg 120, is fluidly connected with the vacuum cavity 158 in the suction cup 110.

The venturi tube 160 is located partially in the first passage 132 in the stem member 110. The venturi tube 160 has an inner surface 162, an outer surface 164, an inlet 166, and an outlet 168. The outer surface 164 of the venturi tube 160 includes a first portion 170, a second portion 172, and a third portion 174. The first portion 170 is adjacent the inlet 166 of the venturi tube 160 and is threaded so as to mate with a nut 176 provided on the flexible air inlet line 90. The second portion 172 of the outer surface 164 of the venturi tube 160 is also threaded. The dimensions of the threads on the second portion 172 are selected so as to mate with the threaded portion 134 of the first passage 132 in the stem member 110. The third portion 174 of the outer surface 164 of the venturi tube 160 tapers from the second portion 172 to the outlet 168 as may be seen in FIG. 3. When the venturi tube 160 is installed in the stem member 110, the outlet 168 of the venturi tube 160 is located substantially radially inward of the second passage 140 in the stem member 110.

The inner surface 162 of the venturi tube 160 defines a flowpath 180 from the inlet 166 of the venturi tube to the outlet 168. The flowpath 180 includes a converging section 182 which leads to a throat section 184 adjacent the outlet 168. The first passage 132 has a circular cross sectional configuration and flares radially and axially outward from a relatively small diameter adjacent to the outlet 168 from the venturi tube 160 to an opening to the atmosphere around the apparatus 10 (FIGS. 2 and 3).

In order to engage and move one of the signatures, denoted as 20*a*, relative to the stack of signatures 20 in the hopper 14, a vacuum is generated in the suction heads 50 and 52 as described below. Pressurized air from the pressurized air source is provided to the pressure regulator 80 which limits the air pressure to a specific pressure level. The pressurized air is then supplied via the air supply line 96 to the electronically controlled valve 70. When the valve 70 receives an electrical signal from the system controller that a vacuum is required in the suction heads 50 and 52, the valve 70 will open so that the pressurized air passes through the supply line 94 to the manifold 60. The pressurized air in the manifold 60 is then distributed to the flexible air lines 90 and 92 which connect the manifold 60 with the venturi tube 160 in the suction heads 50 and 52, respectively.

The pressurized air enters the inlet 166 of each venturi tube 160 and is directed along the flowpath 180 inside the venturi tube. In the flowpath 180 of the venturi tube 160, the converging section 182 accelerates the air. The air is passed through the converging section 182 and into the throat section 184 of the venturi tube 160. When the accelerated air passes through the throat section 184, the air has a relatively high total (or dynamic) pressure and a relatively low static pressure, thereby generating a vacuum at the outlet 168 of the venturi tube 160. The vacuum which is generated at the venturi tube outlet 168 extends to a surrounding area 190 inside the stem member 110. The vacuum in the area 190 surrounding the outlet 168 of the venturi tube 160 is communicated to the second passage 140 which extends outward from that vicinity. The vacuum which has been communicated to the second passage 140 is sufficient to evacuate the vacuum cavity 158 inside the suction cup 150 when the suction cup 150 is engaged with or closely adjacent the signature 20*a*. The vacuum inside the suction cup 150 causes an exposed portion 20*b* of the signature 20*a* on the bottom of the stack of signatures 20 to be pulled against the peripheral lip 156 on the upper section 152 of the suction cup.

With the portion 20*b* of the signature 20*a* gripped by the suction cup 150, the signature 20*a* can be moved relative to the stack of signatures 20 The retractable support 19 is moved to the right as shown in FIG. 1 to allow the signature 20*a* to be removed through the removal window 18. The mechanism 56 rotates the suction heads 50 and 52 clockwise in the direction of arrow D to the position indicated by the dashed lines in FIG. 1. In this position, the signature 20*a* is gripped by the gripper finger 34. The valve 70 is then closed so that the air supply to the venturi tube 160 is cut off and consequently the vacuum is lost. The drum 30 and the gripper finger 34 with the signature 20*a* gripped therein are rotated approximately 180° where the gripper finger 34 releases the signature 20*a* into one of the pockets 40. By this time, the mechanism 56 has rotated the suction heads 50 and 52 in the direction of arrow E to their original position underneath the removal window 18 of the hopper 14 and the retractable support 19 has been moved to the left in FIG. 1 to again support the stack of signatures 20 in the hopper 14. Also, the valve 70 has been reopened so that a vacuum will be generated in the suction heads 50 and 52 to grip the next signature in the stack of signatures 20.

A primary advantage of the present invention is that the vacuum is generated directly at the point of use rather than being generated at a remote location. This provides quick response between the time the electronically controlled valve 70 is opened and the time that a vacuum is generated in the suction heads 50 and 52. Further, with the vacuum being generated independently in each of the suction heads 50 and 52, if one of the suction heads loses vacuum and does not properly grip a signature, the other suction head will still be at full vacuum to grip the signature. This feature of the present invention will help to increase feed efficiencies for the machine 12.

By electronically controlling the valve 70, the overall operating efficiency of the machine 12 will be improved because a vacuum is only generated when needed. According to one method of practicing the invention, a vacuum is generated in the suction heads 50 and 52 based on a predetermined timing sequence which is programmed into the system controller. According to another method of practicing the invention, the timing of the generation of a vacuum in the suction heads 50 and 52 is dynamically controlled by the system controller. The latter method allows the timing of the vacuum to be advanced or retarded based on the requirements for a given product or based on system parameters such as the speed of the machine 12. Such an adjustment to the timing can be accomplished either manually or automatically.

Yet another advantage of the present invention is that there is no need to blow down the air lines to clear out paper dust. Any paper dust which is sucked into the suction heads 50 and 52 is forced out of the suction heads by the air flow through the first passage 132 in each head.

From the above description of the invention, those skilled in the art will perceive improvements, changes, and modifications of the invention. For example, it is contemplated that each suction head could be supplied by its own respective air pressure valve and associated pressure regulator so that the vacuum generated in each suction cup is independently controllable. Further, it should be obvious to one skilled in the art that the venturi tube 160 could be secured to the stem member 110 by another means such as a press fit rather than the threaded connection shown. Similarly, the air inlet line could be connected to the venturi tube 160 by another means such as a quick-disconnect coupling, rather than the threaded connection shown. Such improvements, changes, and modifications are intended to be covered by the appended claims.

Having described the invention, I claim:

1. Apparatus for engaging at least a portion of a signature in a hopper and moving the portion relative to a stack of signatures in the hopper, said apparatus comprising:

a stem member having a surface which faces toward the stack of signatures;

a leg connected to and extending outward from said stem member at an angle of 60° to 80° relative to said surface of said stem member;

a suction cup mounted on said leg;

means for supporting said stem member for movement toward and away from the stack of signatures;

said stem member having a first passage through said stem member through which air is directed;

said stem member having a second passage which extends through said leg into communication with said suction cup; and a venturi tube at least partially disposed in said first passage for generating a vacuum which is communicated to said second passage and to said suction cup in response to the flow of air through said first passage, the vacuum in said suction cup causing said portion of a signature to be gripped by said suction cup and moved relative to the stack of signatures in the hopper upon movement of said stem member away from the stack of signatures.

2. An apparatus as set forth in claim 1 wherein said leg extends substantially perpendicular to said portion of a signature when said portion of a signature is gripped by said suction cup.

3. An apparatus as set forth in claim 1 wherein said first passage has a first cross sectional area in a first plane extending perpendicular to a longitudinal central axis of said first passage at a location adjacent to said venturi tube and has a second cross sectional area in a second plane perpendicular to a longitudinal central axis of said first passage at a location adjacent to an end of said first passage opposite from said venturi tube, said second cross sectional area is larger than said first cross sectional area.

4. An apparatus as set forth in claim 1 wherein said second passage continuously flares transversely outward in a direction away from said venturi tube.

5. Apparatus for engaging at least a portion of a signature in a hopper and moving the portion relative to a stack of signatures in the hopper, said apparatus comprising:

a stem member pivotal toward and away from the stack of signatures in the hopper;

a suction cup mounted on said stem member and movable with said stem member relative to the stack of signatures in the hopper;

means for supporting said stem member for pivotal movement toward and away from the stack of signatures;

said stem member having a first passage through said stem member through which air is directed to atmosphere around said apparatus;

said stem member having a second passage in communication with said suction cup;

a venturi tube at least partially disposed in said first passage;

an air supply conduit connected in fluid communication with said venturi tube; and a valve connected with said air supply conduit and operable between an open condition and a closed condition, said valve being effective to enable air to flow from said venturi tube through said first passage in said stem member to atmosphere to effect generation of a vacuum which is communicated to said suction cup to induce a flow of air from said suction cup through said second passage to said first passage when said valve is in the open condition to thereby cause a portion of a signature to be gripped by said suction cup and moved relative to the stack of signatures in the hopper upon pivotal movement of said stem member away from the stack of signatures, said valve being effective to block a flow of air to said venturi tube and to said first and second passages when said valve is in the closed condition to interrupt the generation of vacuum to thereby release the grip of said suction cup on the signature.

6. An apparatus as set forth in claim 5 wherein said first passage has a first cross sectional area in a plane extending perpendicular to a longitudinal central axis of said first passage at a location adjacent to said venturi tube and has a second cross sectional area in a plane perpendicular to a longitudinal central axis of said first passage at a location adjacent to an opening to atmosphere, said second cross sectional area being larger than said first cross sectional area.

7. An apparatus as set forth in claim 6 wherein said second passage continuously flares transversely outward from said first cross sectional area to said second cross sectional area.

8. An apparatus as set forth in claim 5 wherein said first passage has a longitudinal central axis which is skewed at an acute angle to a longitudinal central axis of said second passage.

* * * * *